US005613433A

United States Patent [19]

Tucoulat et al.

[11] Patent Number: 5,613,433

[45] Date of Patent: Mar. 25, 1997

[54] COMPACTING METHOD AND APPARATUS, PARTICULARLY ADAPTED TO COMPACTING HAZARDOUS MATERIALS

[75] Inventors: Daniel Tucoulat, Cormeilles en Parisis; Patrick Jacq; Philippe Kerrien, both of Montigny le Bretonneux; Daniel Kerlau, Chatenay-Malabry, all of France

[73] Assignee: Compagnie Generale des Matieres Nucleaires, Velizy-Villa Coublay, France

[21] Appl. No.: 464,868

[22] PCT Filed: Jan. 13, 1994

[86] PCT No.: PCT/FR94/00040

§ 371 Date: Jun. 28, 1995

§ 102(e) Date: Jun. 28, 1995

[87] PCT Pub. No.: WO94/16449

PCT Pub. Date: Jul. 21, 1994

[30] Foreign Application Priority Data

Jan. 15, 1993 [FR] France ..... 93 00360

[51] Int. Cl.[6] ..... B30B 9/32

[52] U.S. Cl. ..... 100/35; 100/218; 100/229 R; 100/902

[58] Field of Search ..... 100/35, 229 R, 100/215, 218, 246, 902

[56] References Cited

U.S. PATENT DOCUMENTS

| | | | |
|---|---|---|---|
| 737,427 | 8/1903 | Lemberg | 100/229 R |
| 975,844 | 11/1910 | Egbert | 100/229 R |
| 2,641,122 | 6/1953 | Cavagnaro, Jr. et al. | 100/229 R |
| 3,416,436 | 12/1968 | Tezuka | 100/229 R |
| 4,065,299 | 12/1977 | Roberts et al. | 75/67 A |
| 4,631,015 | 12/1986 | Shigeo et al. | 100/246 |
| 4,809,600 | 3/1989 | Yamamoto et al. | 100/246 |
| 4,897,222 | 1/1990 | Müntzel et al. | 100/229 R |

FOREIGN PATENT DOCUMENTS

| | | |
|---|---|---|
| 081074 | 6/1983 | European Pat. Off. . |
| 484218 | 9/1917 | France . |
| 484871 | 11/1917 | France . |
| 3314521 | 10/1984 | Germany . |
| 89/10257 | 11/1989 | WIPO . |
| 91/04148 | 4/1991 | WIPO . |

*Primary Examiner*—Stephen F. Gerrity
*Attorney, Agent, or Firm*—Cohen, Pontani, Lieberman, Pavane

[57] ABSTRACT

A compacting method and apparatus particularly adapted to compacting hazardous materials, and in particular radioactive waste, in which a container (1, 1', 1", 1'") is compacted inside a compacting skirt (20) by cooperation between a support surface (7) on which the compacting skirt (20) with the container (1') is placed and a compactor (9) disposed faing the support surface (7) and displaceable along a vertical axis inside the compacting skirt (20). According to the compacting method the compacting skirt (20) containing the container (1, 1', 1", 1'") is moved in translation, in particular between a loading station (I) for loading the container (1), a compacting station (II) where the container (1') is compacted, and an unmolding station (III) for unmolding the compacted container (1") and for evacuating the compacted container (1'") downwards.

18 Claims, 3 Drawing Sheets

COMPACTING METHOD AND APPARATUS, PARTICULARLY ADAPTED TO COMPACTING HAZARDOUS MATERIALS

The present invention relates to a compacting method that is particularly adapted to compacting hazardous materials, and in particular radioactive waste.

The present invention also relates to an apparatus for implementing said compacting method.

The invention has been designed and developed in the nuclear context. It is described below more particularly with reference to that context, however, on reading the following text, the person skilled in the art will readily understand that the principle of the invention—compacting along a vertical axis with the compacting skirt being moved in translation between a compacting station and an unmolding station—is transposable to other domains.

Compacting by means of vertical axis presses is conventionally performed in zones that are freely accessible, where maintenance does not pose any special problem. In that context without any contamination problem, materials are compacted inside a compacting skirt by moving compression means in translation vertically downwards. Said compacted materials are unmolded at the same station, by raising said compacting skirt while keeping said compression means in the low position. It is not possible to transpose that technique to contaminated surroundings, e.g. nuclear contamination, given that specific maintenance problems arise, which maintenance can only be performed by remote operation using specific tooling.

The invention proposes modifying that vertical axis compacting technique by separating the functions required for compacting, thereby facilitating access to the mechanical members used and also facilitating disassembly thereof.

The presently claimed compacting method is of the type whereby a container is compacted inside a compacting skirt by co-operation between a support surface on which said skirt is positioned with said container, and compacting means disposed facing said support surface and displaceable along a vertical axis inside said skirt. It is characterized in that it comprises moving said compacting skirt in translation between a plurality of stations, and in particular between a loading station for loading said container, a compacting station where said container is compacted, and an unmolding station comprising unmolding means for unmolding the compacted container, and discharge means for discharging said compacted container downwards.

In characteristic manner, the compacted container is not unmolded in the compacting station. The compacting and unmolding stations constitute two different workstations between which the compacting skirt containing the container is moved in translation.

At the end of compacting, the compacting skirt is not raised to unmold the compacted container in situ. It is the compression means that are raised, thereby releasing said skirt for transfer from said compacting station to said unmolding station.

It is essential to have an unmolding station since the compacted container remains jammed inside the skirt because of the radial pressure that results from compacting.

Various steps are listed below in a preferred variant of the method of the invention. Said method advantageously consists:

in inserting the container loaded with the materials to compact into the mobile compacting skirt in a "loading" station;

in transferring said mobile skirt with the loaded container from said loading station to the compacting station;

in positioning said mobile skirt in said compacting station so as to put said container on the support surface facing the compacting means;

in performing compacting by moving said compacting means along a vertical axis inside said skirt;

in transferring said mobile skirt containing the compacted container from said compacting station to the unmolding station;

in unmolding and recovering said compacted container in said unmolding station; and in transferring the mobile skirt as emptied in this way to the loading station to receive a new load, or to a maintenance station.

Said method is implemented at four different workstations: the loading station, the compacting station, the unmolding station, and the maintenance station. In characteristic manner, the unmolding station and the compacting station are dissociated. As mentioned hereafter, they make use of different means. In a variant of the method of the invention, the loading station and the maintenance station may be combined. Advantageously, the container is inserted into the compacting skirt from above.

Said compacting skirt is thus transferred from one of the stations to the other. To this end, it is advantageously caused to be mobile. Thus, said skirt may be mounted on a carriage fitted with a wheel device and with onboard or independent drive means. Other devices may be considered for moving the compacting skirt in translation from one workstation to another. Said devices are designed to transfer said skirt. They must also enable it to be accurately positioned in the compacting station and withstand the compacting force. Thus, the above-described wheels of the carriage are retractable. The carriage is also advantageously provided with shock absorbers and with stops . . . .

For positioning at the compacting station, said carriage is stopped by a fixed abutment and is then subjected to drive from vertical axis actuators. Under drive from said actuators, the wheels are retracted and the carriage is pressed against the ground. It is thus locked in place for compacting. The container inside the compacting skirt is thus accurately positioned on the support surface, facing the compacting means. Said means can apply their force.

The method of the invention is implemented to compact cylindrical containers having respective covers. It enables said compacting to be performed under remote control and is thus entirely suitable for compacting hazardous materials, and in particular radioactive waste.

The containers may contain various types of materials that are to be reduced in volume, in particular for the purpose of optimizing storage thereof. The materials may thus be constituted by radioactive waste, and in particular irradiated metal waste of pyrophoric tendency. Such waste is generated, for example, during the reprocessing of irradiated nuclear fuel elements. Thus, the shearing of said elements gives rise firstly to fuel in solution and secondly to pieces of tube or "hulls", generally made of zircalloy. At present, said hulls are washed and then placed in drums. Said drums are then embedded in cement without being reduced in volume. The same applies to storing other materials, and in particular to storing other structural elements of said fuels, such as grids and endpieces, . . . and also to storing magnesium.

When implemented with special precautions, the method of the invention makes it possible to compact said drums, and more generally to compact said waste of pyrophoric tendency. Said special conditions are intended to prevent any risk of explosion and/or ignition during compacting. They consist in internal blanketing, and optionally external blanketing. An inert gas is used. Compacting is performed on containers that are saturated in said inert gas. During compacting, contact should be avoided between oxygen and the compacted materials, and in particular the fines generated during said compacting.

The method of the invention can thus be implemented to compact containers that are saturated in inert gas (nitrogen, argon, . . . ) and that contain irradiated metal waste.

Such compacting can bring considerable amounts of energy into play without danger.

The invention also provides apparatus useful in implementing the above-defined compacting. Said apparatus comprises three independent subassemblies:

a vertical axis compacting power generator or press;

a carriage fitted with a retractable wheel device and having onboard or independent drive means, and on which the compacting skirt is mounted; and an unmolding power generator.

The selected press is of the vertical type having columns and is of conventional design. It includes a main jack whose drive serves to compact the container, and advantageously auxiliary jacks: two jacks disposed symmetrically on either side of said main jack.

Said auxiliary jacks are used in positioning the compacting skirt relative to the compacting station, before said compacting.

The unmolding power generator consists in a jack whose drive serves to eject the compacted container towards an appropriate receptacle. Said receptacle is provided in the unmolding station. If necessary, it is fitted with temporary closure means.

According to the essential characteristic of the method of the invention, the apparatus designed to cause the compacting skirt to be mobile consists advantageously in a carriage. Other devices may also be used.

In a preferred variant, the compacting skirt is an interference fit in a skirt-carrier cradle itself mounted on the carriage.

Said carriage is fitted with a retractable wheel device or with any other equivalent device enabling it to move from one station to another and enabling it to be positioned in the compacting station. Such movement is driven by drive means that are onboard or independent. Advantageously, use is made of two pusher chains that are symmetrically connected on either side of the middle axis of the carriage to a rudder-yoke disposed beneath said carriage. This ensures an accurately defined center of thrust.

The carriage is advantageously caused to move on a plane that is substantially horizontal. Nevertheless, there may be a gentle or even a steep slope between various workstations. In any event, compacting is performed on a horizontal support surface.

Advantageously, lateral shoes are provided on the carriage to prevent any rotation or possible movement of the carriage during compacting: said lateral shoes are designed to co-operate in the compacting station with lateral abutments.

Said carriage is also advantageously fitted with shock absorbers, stops, . . . or any other means suitable for intervening in the positioning thereof prior to compacting.

It is also possible to provide fittings on the carriage and/or the compacting skirt for receiving and transporting the tooling required for maintenance within the compacting cell.

For the treatment of hazardous materials said cell is confined, e.g. for the treatment of radioactive waste. Said confinement does not impede implementation of the method of the invention. The method and the apparatus described above can be used under remote control.

The method and apparatus of the invention are illustrated in the figures accompanying the present text.

FIG. 1A shows the four main steps of the method of the invention. These steps are performed in four different workstations constituting a repeatable cycle:

I: the loading station for loading the container that is to be compacted (it is loaded into the compacting skirt which is mounted on a carriage);

II: the compacting station;

III: the unmolding station where the compacted container or compact is unmolded; and IV: the maintenance station for the carriage on which the compacting skirt is mounted.

Figure 1A:
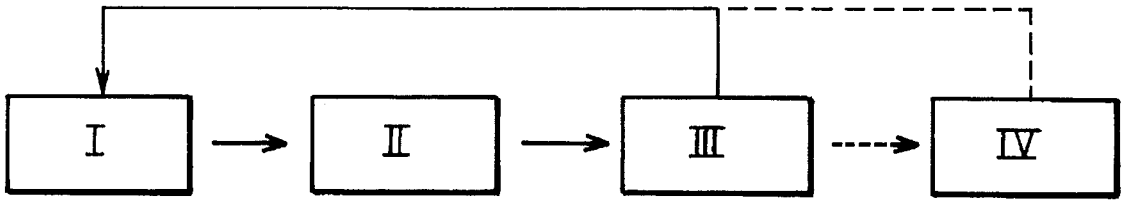
FIGS. 1A and 1B are block diagrams of two variants of the method of the invention.
Figure 1B:
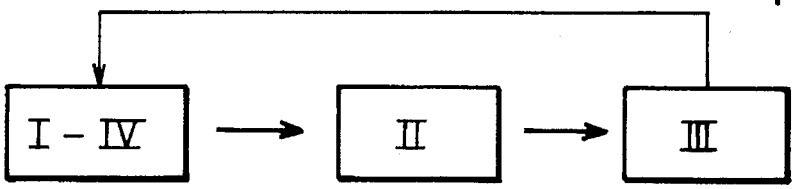

FIG. 1B shows a variant of the method of the invention. In said variant:

the loading and maintenance stations are combined; and the carriage performs cycles.

Figure 2:
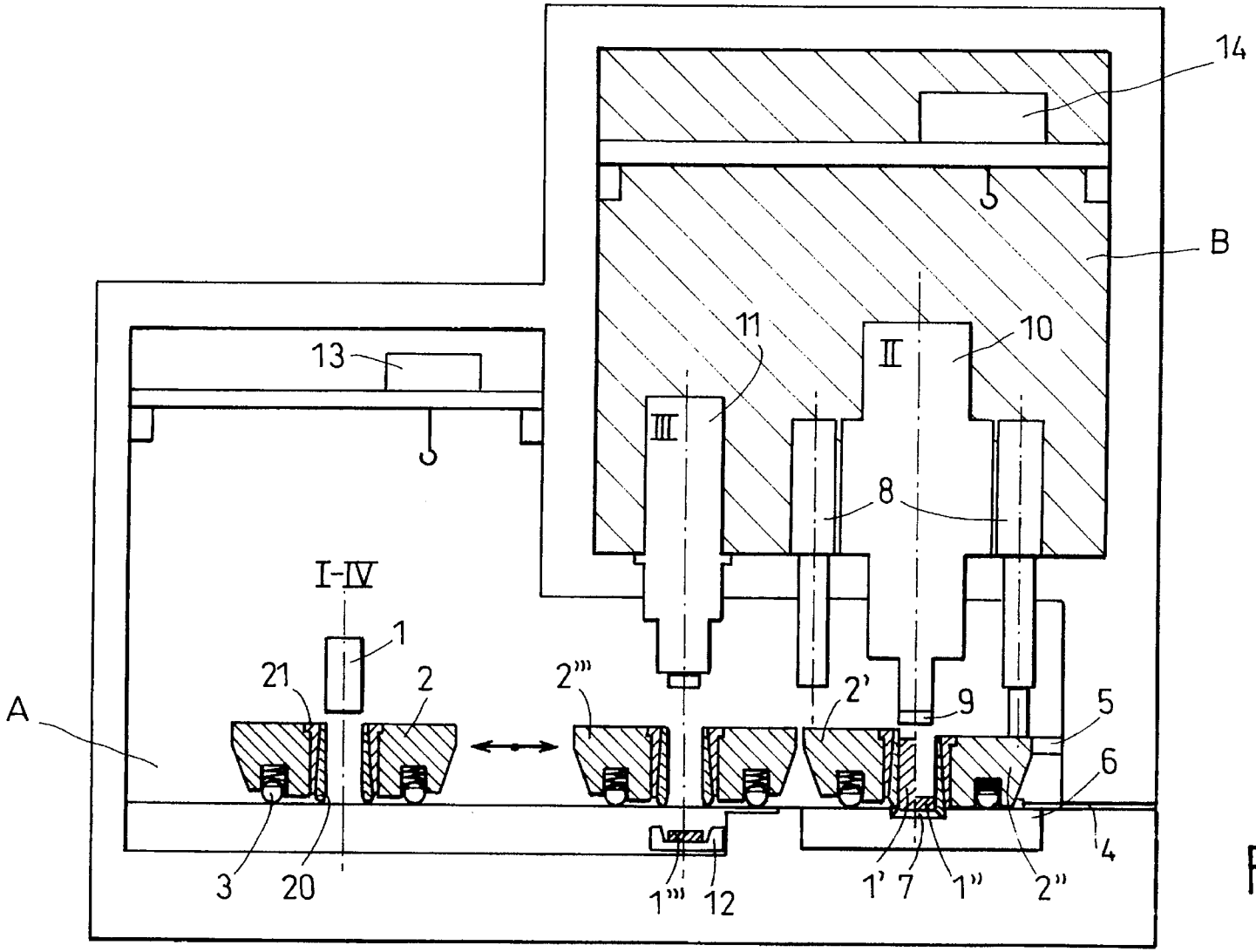
FIG. 2 is a diagram showing the principle implemented in the present invention (preferred variant) in a contaminated zone.

FIG. 2 shows the implementation of said variant of the method of the invention, as implemented in a contaminated zone A. The shaded zone B is not contaminated.

The apparatus of the invention comprises three independent subassemblies:

the compacting power generator 10;

the carriage 2, 2', 2", 2'" fitted with retractable wheels 3 and with independent drive means 4; which carriage 2, 2', 2", 2'" has the compacting skirt 20 mounted thereon. Said carriage is described in greater detail below with reference to FIG. 3; and the unmolding power generator constituted by a jack 11.

The carriage is referenced 2 in the loading station I, 2' in the compacting station II, prior to compacting; 2" in the compacting station during and after compacting; and 2'" in the unmolding station III. It is recalled that in the illustrated variant, the loading station I and the maintenance station IV are combined.

Similarly, reference 1 designates the container to be compacted in the loading station I; 1' said container in the compacting station II, prior to compacting; 1" said compacted container or compact in the compacting station II", after compacting; and 1'" said compacted container or compact in the unmolding station III.

Said container 1 is inserted into the compacting skirt 20 mounted on the carriage 2 in the loading station I by being moved vertically downwards. The compacting skirt 20 is an interference fit in a cradle 21 which is itself mounted (bolted) on the carriage 2. The diameter of said skirt 20 is adapted to the diameter of the container 1. A reasonable amount of clearance is provided.

The assembly 20+21+2 is then transferred under drive from pusher chains 4 to the compacting station II. During this transfer, the container is in fact pulled. It scrapes along the bottom of the cell.

In the compacting station II, the assembly must be accurately positioned on the bottom plate or jaw of the press 6. More precisely, the skirt and the container 1' must be accurately positioned on the anvil 7 facing the punch (or chisel) of the press 9.

Positioning takes place in three stages:

the carriage 2' is stopped on a fixed abutment 5. A shock absorber device 22 (see FIG. 3) is provided on said carriage to prevent it bouncing;

two auxiliary jacks 8, positioned on either side of the main compacting jack move down and compress the retractable wheels 3 so as to put the compacting skirt 20 into conical bearing contact (conicity close to 45°) with the anvil 7. Said skirt 20 and said anvil 7 are designed so that under drive from said auxiliary actuators 8, said skirt 20 engages conically on said anvil 7. Lateral shoes 25 co-operate with lateral abutments 26 preventing any rotation during compacting of the carriage 2' carrying said skirt 20 (cf. FIG. 4). The carriage during positioning and when positioned is described in greater detail with reference to FIG. 3;

thereafter, the power applied by said auxiliary jacks 8 is increased to exert a pressing force on the carriage 2' (and the compacting skirt 20). This pressing force is essential during compacting in order to hold the skirt 20 in position, to prevent the bottom of the container 1" sliding beneath said skirt 20, and to counter any tilting torque that may occur.

Compacting can then be performed by lowering the punch 9 in conventional manner. If necessary, said compacting is implemented with external and/or internal blanketing.

At the end of compacting, a compact 1" is obtained. The main jack and said punch 9 are then raised. Thereafter the auxiliary jacks 8 are raised. The carriage 2" returns to the position 2', with its wheels 3 no longer being retracted. Said carriage 1' is then transferred to the unmolding station III. Its positioning relative to the unmolding actuator 11 may be performed by means of an encoder or a removable abutment (not shown). Also provided are a device (not shown) enabling the wheels to be retracted again so as to avoid any bouncing phenomenon at the end of unmolding the compact 1''', and another device (not shown) which puts the unmolding station III into communication with a receptacle 12. Said compact 1''' is ejected towards said receptacle 12 which is situated lower down by thrust from an unmolding jack 11. Thereafter it is transferred to a station for loading compacts, e.g. in a glass type drum.

The carriage 2''' can then be moved again in translation towards the loading station I and it is possible to start a new cycle: loading—compacting—unmolding.

Provision is also made for maintenance operations to be performed in said station I–IV, with said maintenance being performed by remote control.

Travelling cranes for maintenance purposes are shown diagrammatically at 13 and 14.

Figure 4:
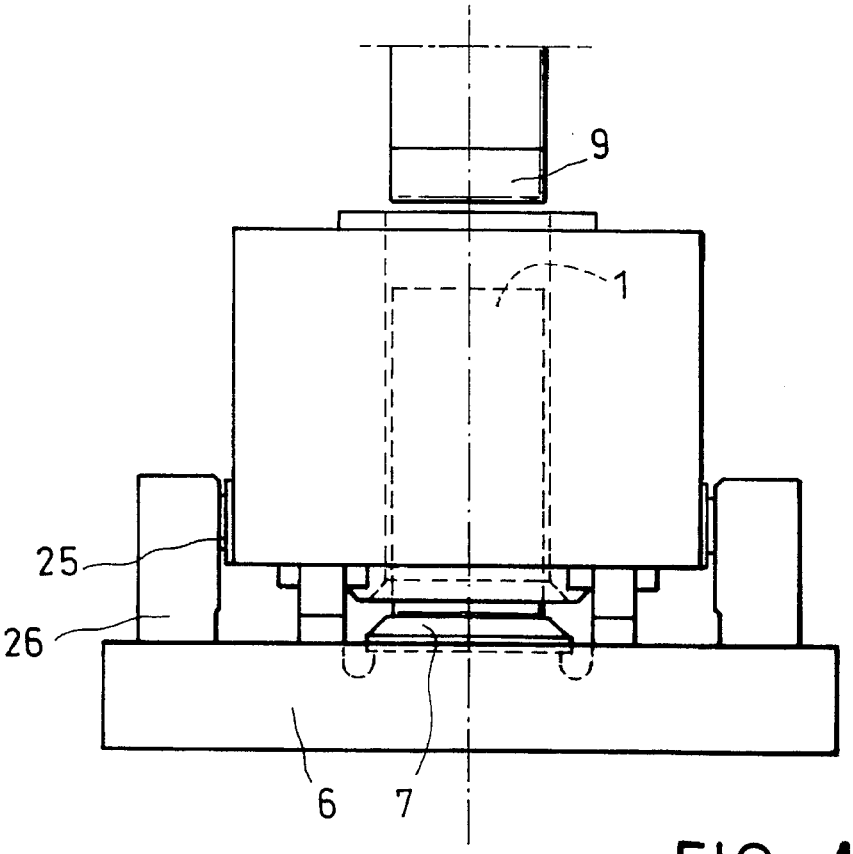
FIG. 4 is another view, seen from the outside, of the carriage on which the compacting skirt is mounted.
Figure 3:
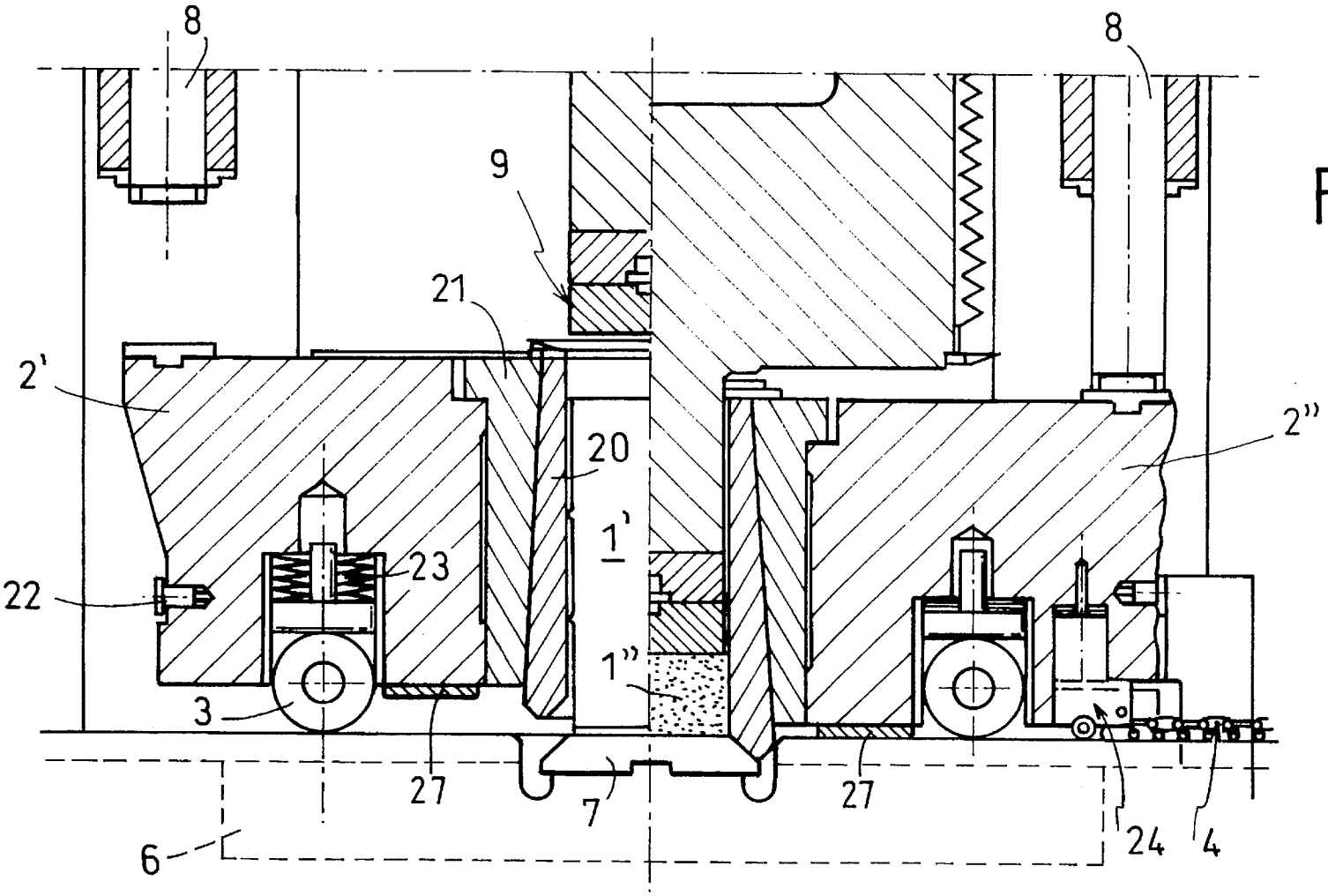
FIG. 3 is a section through the carriage on which the compacting skirt is mounted. In the lefthand portion of said figure, the carriage is shown prior to being positioned for compacting; in the righthand portion, said carriage is shown at the end of compacting.

There follows a more detailed description, with reference to FIGS. 3 and 4, of the carriage 2, 2', 2", 2''' fitted with the compacting skirt 20, which is thus made mobile. As mentioned above, said skirt 20 is externally conical in shape. It is engaged as a force-fit in the skirt-carrier cradle 21. The cradle is itself bolted to the carriage 2', 2" (in FIG. 3). Four lateral shoes 25 that can be interchanged under remote control are mounted on the carriage. As mentioned above, they are intended to co-operate with abutments 26 to prevent any rotation or movement of the skirt during compacting (see FIG. 4).

The carriage is moved in the cell by two pusher chains 4 connected to a rudder-yoke 24. The advantage of the rudder-yoke is that it allows said pusher chains 4 to pass on either side of the anvil 7 while still having a thrust center on the middle axis of the carriage. The said rudder-yoke 24 is mounted on a castor and shock absorber (not shown).

The following are provided in the structure of the carriage:

stops 27 placed underneath. They serve to prevent said carriage becoming unbalanced in the event of the two auxiliary jacks 8 not exerting their thrust simultaneously;

horizontal shock absorbers 22 which prevent any bounce phenomenon when the carriage comes into abutment against the fixed abutment 5; and retractable wheels 3 with shock absorbers 23 (resilient washers) enabling the carriage (2, 2', 2", 2''') to be moved and enabling it to be accurately positioned in the compacting station (II).

The method of the invention as described above can be implemented, in particular, for compacting stainless steel containers (diameter 390 mm, height 800 mm) containing dry zircalloy hulls and various other pieces of metal debris (relative density of the metal itself_6.2–6.6, apparent relative density of the mixture in the container ~1). The nature of these materials, and the presence of fines together with them require confinement and blanketing (using argon or nitrogen) during compacting.

The compacting station is fitted with a 2,500 (metric) ton press. The pressure per unit area exerted by said press is 200 MPa.

The unmolding station for unmolding the compacted container or compact is fitted with a 250 (metric) ton hydraulic jack.

Compacts are obtained that are about 150 mm high, having a relative density of 4.1.

We claim:

1. A compacting method suitable for compacting hazardous materials, in which a container (1, 1', 1", 1''') is compacted inside a mobile compacting skirt (20) by cooperation between a support surface (7) on which said skirt (20) with said container (1') is placed, and compacting means (9) disposed facing said support surface (7) and displaceable along a vertical axis inside said skirt (20), the method comprising moving said compacting skirt (20) containing said container (1, 1', 1", 1''') in translation between a loading station (I) for loading said container (1), a compacting station (II) where said container (1') is compacted, and an unmolding station (III) having unmolding means (11) for unmolding the compacted container (1") from said skirt and evacuation means for evacuating said compacted container (1''') downwards.

2. A method according to claim 1, comprising the steps of:

(a) inserting said loaded container (1) into said mobile compacting skirt (20) in said loading station (I);

(b) transferring said mobile skirt (20) with said container (1) from said loading station (I) to said compacting station (II);

(c) positioning said mobile skirt (20) in said compacting station (II) with said container (1') on said support surface (7) facing said compacting means (9);

(d) compacting said container (1') by moving said compacting means (9) along said vertical axis inside said skirt (20);

(e) transferring said mobile skirt (20) containing said compacted container (1''') from said compacting station (II) to said unmolding station (III);

(f) unmolding said compacted container (1''') from said mobile skirt (20) and collecting said unmolded compacted container (1''') in a receptacle (12) in said unmolding station (III); and (g) transferring said emptied mobile skirt (2''') to a station selected from the group consisting of a loading station (I) to receive a new load and a maintenance station (IV).

3. A method according to claim 2, wherein said compacting skirt (20) is mounted on a carriage (2, 2', 2", 2"') having a retractable wheel device (3) and a drive means for said wheel device (3) selected from the group consisting of an onboard drive means and an independent drive means (4), and further comprising the step of driving said wheel device (3) of said carriage (2, 2', 2", 2"') with said drive means.

4. A method according to claim 3, wherein positioning said compacting skirt (20) in said compacting station (II) further comprises the steps of stopping said carriage (2') with a stationary abutment (5) and then subjecting said carriage (2') to drive from vertical axis jacks (8) for retracting said retractable wheel device (3) of said carriage and locking said carriage in the compacting position.

5. A method according to claim 4 wherein said compacting containers (1, 1', 1", 1"') contain irradiated metal waste and are saturated in inert gas for minimizing the risk of explosion or ignition of said waste during compacting.

6. A method according to claim 1, wherein said compacting skirt (20) is mounted on a carriage (2, 2', 2", 2"') having a retractable wheel device (3) and a drive means for said wheel device (3) selected from the group consisting of an onboard drive means and an independent drive means (4), and further comprising the step of driving said wheel device (3) of said carriage (2, 2', 2", 2"') with said drive means.

7. A method according to claim 6, wherein positioning said compacting skirt (20) in said compacting station (II) further comprises the steps of stopping said carriage (2') with a stationary abutment (5) and then subjecting said carriage (2') to drive from vertical axis jacks (8) for retracting said retractable wheel device (3) of said carriage and locking said carriage in the compacting position.

8. A method according to claim 1, wherein said compacting containers (1, 1', 1", 1"') contain irradiated metal waste and are saturated in inert gas for minimizing the risk of explosion or ignition of said waste during compacting.

9. Compacting apparatus suitable for compacting containers loaded with hazardous materials, said apparatus comprising:

a vertical axis compacting power generator (10) for compacting said container;

a carriage (2, 2', 2", 2"') having a retractable wheel device (3) and a drive means (4) selected from the group consisting of an onboard drive means and an independent drive means;

a mobile compacting skirt (20) mounted on said carriage (2, 2', 2", 2"');

a support surface (7) on which said skirt (20) with said container is placed; and an unmolding power generator (11) for unmolding the compacted container (1"') from the mobile skirt (20) and ejecting the compacted container (1"') from the mobile skirt (20) towards a receptacle (12).

10. The compacting apparatus as defined in claim 9, wherein said compacting power generator (10) comprises a compacting main jack and auxiliary jacks (8) for positioning said compacting skirt (20) in said compacting station (II).

11. The compacting apparatus as defined in claim 10, wherein said unmolding power generator comprises a jack (11) for ejecting said compacted container (1"') towards an appropriate receptacle (12).

12. The compacting apparatus as defined in claim 11, wherein said carriage (2, 2', 2", 2"') further comprises a skirt-carrier cradle (21) mounted thereon, said compacting skirt (20) interferingly fitting within said skirt-carrier cradle (21).

13. The compacting apparatus as defined in claim 12, wherein said carriage (2, 2', 2", 2"') further comprises a rudder-yoke (24) having two pusher chains (4) symmetrically connected thereto on either side of a middle axis.

14. The compacting apparatus as defined in claim 13, wherein said carriage (2, 2', 2", 2"') further comprises lateral shoes (25) for cooperating in said compacting station (II) with lateral abutments (26) to prevent movement of said skirt (20) during compacting.

15. The compacting apparatus as defined in claim 9, wherein said unmolding power generator comprises a jack (11) for ejecting said compacted container (1"') towards an appropriate receptacle (12).

16. The compacting apparatus as defined in claim 9, wherein said carriage (2, 2', 2", 2"') further comprises a skirt-carrier cradle (21) mounted thereon, said compacting skirt (20) interferingly fitting within said skirt-carrier cradle (21).

17. The compacting apparatus as defined in claim 9, wherein said carriage (2, 2', 2", 2"') further comprises a rudder-yoke (24) having two pusher chains (4) symmetrically connected thereto on either side of the middle axis.

18. The compacting apparatus as defined in claim 9, wherein said carriage (2, 2', 2", 2"') further comprises lateral shoes (25) for cooperating in the compacting station (II) with lateral abutments (26) to prevent movement of the skirt (20) during compacting.

* * * * *